350-407 SR

1/1/85 XR 4,491,326

United States Patent [19]

Halsey, III

[11] Patent Number: 4,491,326

[45] Date of Patent: Jan. 1, 1985

[54] PUZZLE HAVING POLARIZED STACKABLE COMPONENTS

[76] Inventor: Donald P. Halsey, III, 1348 Middleton Ct., Los Altos, Calif. 94022

[21] Appl. No.: 478,466

[22] Filed: Mar. 24, 1983

[51] Int. Cl.³ ..... A63F 9/12

[52] U.S. Cl. ..... 273/157 A; 350/407

[58] Field of Search ..... 273/157 A; 350/388, 350/390, 396, 407

[56] References Cited

U.S. PATENT DOCUMENTS 2,617,329 11/1952 Dreyer ..... 350/396

4,364,375 12/1982 Younghouse ..... 350/407

4,402,510 9/1983 Yokoi ..... 273/157 A X

*Primary Examiner*—Anton O. Oechsle

*Attorney, Agent, or Firm*—Paul L. Hickman

[57] ABSTRACT

A puzzle characterized by a number of stackable components each provided with an activated area consisting of a plurality of polarized zones. Each zone is polarized along one of two mutually perpendicular axes. The stackable components appear to be identical when separated, but when stacked together the appearance of the resultant solid will be dependent upon the alignment of the polarized zones of adjacent component. The object of the puzzle is to make the resultant solid totally transparent, totally opaque, or some other predetermined pattern of transparency and opacity.

20 Claims, 5 Drawing Figures

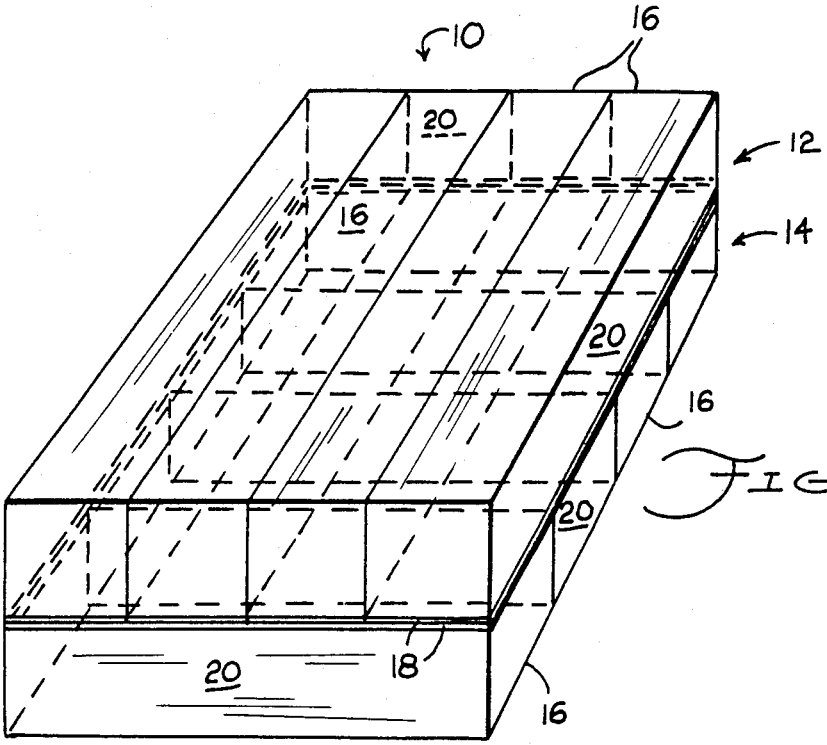
FIG-1-
FIG-2-
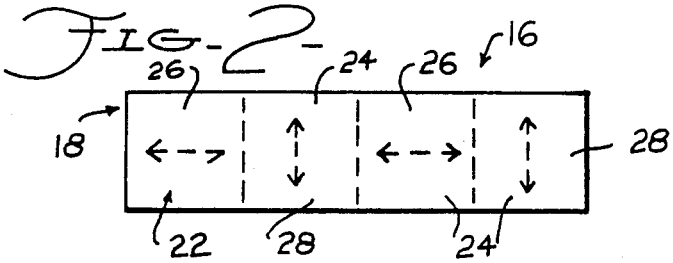
FIG-3-
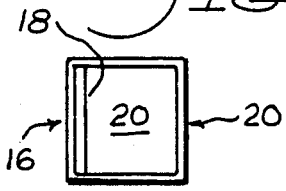
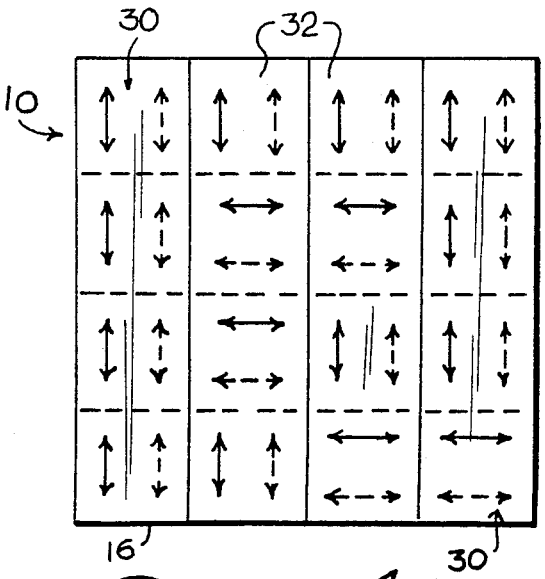
FIG-4-
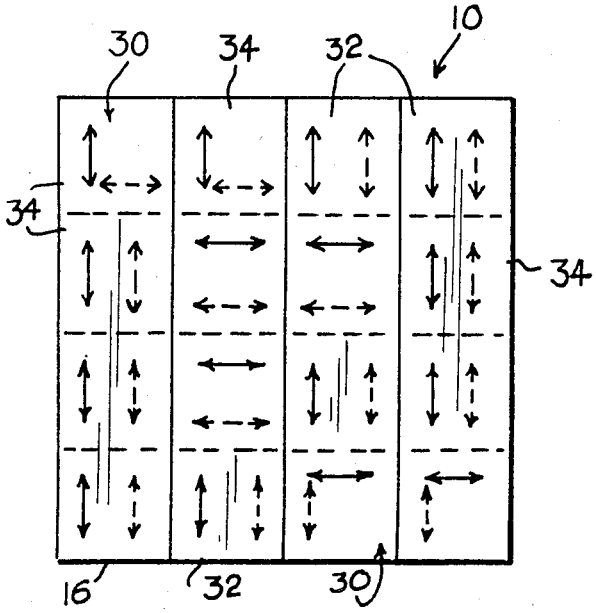
FIG-5-

PUZZLE HAVING POLARIZED STACKABLE COMPONENTS

BACKGROUND OF THE INVENTION

1. Field of the Invention

The present invention relates generally to games and puzzles and more particularly to puzzles in which a plurality of pieces are arrayed to achieve desired patterned results.

2. Description of the Prior Art

One type of spatial or visual puzzle is solved by the proper arrangement of pre-selected units to achieve a desired result. For example, the "Chinese Puzzle", in which a number of oddly shaped pieces can be combined in only one way to form a cube or ball or some other regular shape has been known for many centuries. Other examples of spatial puzzles include "Instant Insanity" and "Rubik's Cube".

Several games and puzzles of this type have been the subject of United States Patents. For example, U.S. Pat. No. 2,954,616, issued to D. R. Mogard, discloses a puzzle based learning aid involving the use of a transparent overlay. Similarly, U.S. Pat. No. 4,257,609, issued to R. F. Sqibbs, discloses a puzzle in which individual cubes are arrayed in a manner to provide a composite picture.

Similar devices utilizing individual components to comprise a part of a greater visual whole are disclosed in U.S. Pat. No. 4,308,016, issued to P. A. White and U.S. Pat. No. 2,024,541, issued to E. F. Silkman. A domino related cube puzzle of S. N. Nelson is disclosed in U.S. Pat. No. 3,788,645, a colored cube puzzle of F. H. Kopfenstien is described in U.S. Pat. No. 4,189,151, and a rectangular parallelepiped is taught in U.S. Pat. No. 4,210,333, issued to S. R. Shanin. A puzzle similarly utilizing the principle of component arrangement to form a uniform visual result with the addition of back illumination is disclosed by A. M. Rossetti in U.S. Pat. No. 3,451,681.

The difficulty and challenge of a puzzle can be increased when the various individual components have apparent interchangeability since the components have to be actually assembled to test a theoretical solution. The ancient "Chinese Puzzles" do not have any apparent interchangeability since each of the pieces is different in shape. Furthermore, the apparent interchangeability of puzzles such as "Instant Insanity" is limited because there is a visual disparity between the components or various faces of the components. Any physical or visual disparity among the components limits the number of ways in which the components can be logically assembled and thus decreases the degree of challenge to the person attempting to solve the puzzle because certain combinations can be eliminated mentally.

An example of a prior art puzzle which achieves physical component interchangeability but retains visual disparity is disclosed by H. A. Brooks, et al in U.S. Pat. No. 3,510,134. In U.S. Pat. No. 4,258,479 P. A. Roane teaches a puzzle provided with magnets to facilitate the adhesion of similarly shaped components. Roane utilizes color for encryption.

A great number of the prior art puzzles and games provide substantial enjoyment and challenge. However, since it is generally true that the greater number of possible and logical permutations increases the difficulty and frustration, and hence the enjoyment, of the puzzle it is desirable to maximize the permutation possibilities while still leaving the puzzle within the range of solvability.

SUMMARY OF THE INVENTION

Accordingly, it is an object of the present invention to provide a puzzle in which all of the components are apparently interchangeable, thus providing a maximal number of logical permutations.

It is a further object of the present invention to provide a puzzle assembly with a limited number of components to simplify the manufacture and use of the puzzle.

It is another object of the present invention to provide a puzzle in which the difference between the components are only apparent when the various components are placed in juxtaposition to one another and the difference may not be determined from examination of single components by themselves.

Briefly, a preferred embodiment of the present invention is a geometric and visual puzzle assembly for providing entertainment and mental challenge. The preferred embodiment includes eight components, each of which is an elongated, rectangular solid. The eight rectangular solid components, known as blocks, are physically congruent and apparently visually congruent. Each block has a square cross-section taken perpendicular to its long axis and has a length of four times its width. One of the surfaces of each block, parallel to the long axis, includes an array of four panels which have been polarized with respect to light. The remainder of the surfaces are entirely transparent. The array of polarized panels is selected such that the pattern of polarization is different for each block. The direction of polarization of each panel is selected either to be parallel to the long axis of the block or else perpendicular to that axis.

The net effect of the polarized panels is that when a panel polarized in one direction is visually aligned with a panel polarized in a perpendicular direction, light transmission is occluded resulting in visual opacity. On the other hand, when a panel is visually aligned with another panel of like polarity, light waves having a similar polarity are unimpeded and the result is visual transparency. The object of the puzzle is to array the blocks into a half cube shape such that the entire half cube is transparent. Alternately, it may be desired to attempt to array the eight blocks into a similar shape wherein total visual opacity is obtained to light passing through the composite shape in a given plane. Another possible solution to the puzzle is to arrange the transparent and the opaque panel-pairs to create a desired pattern, such as a checkerboard or a simple picture.

An advantage of the present invention is that the limitation to eight apparently interchangeable components with non apparent dissimilarities maximizes the number of logical permutations while retaining apparent simplicity.

Another advantage of the present invention is that the latent disparities in the individual components manifest themselves in a visual manner only when the components are properly juxtaposed.

A further advantage of the present invention is that the cubic-based shape of the components and resulting composites facilitates stacking and maintenance of the components in desired arrays.

These and other objects and advantages of the present invention will become clear to those skilled in the art upon reading the detailed description of the preferred embodiment which is illustrated in the several figures of the drawing.

BRIEF DESCRIPTION OF THE DRAWING

FIG. 1 is a perspective view of the eight block components of the present invention arrayed into a semi-cubical composite;

FIG. 2 is a top view of one of the blocks illustrating the array of polarized panels;

FIG. 3 is an end view of the block of FIG. 2;

FIG. 4 is a top view of the composite of FIG. 1, illustrating the arrangement of the blocks which achieves transparency; and FIG. 5 is a top view of the composite of FIG. 1 illustrating a block array in which certain of the visual paths are opaque and certain are transparent.

DETAILED DESCRIPTION OF THE PREFERRED EMBODIMENT(S)

The preferred embodiment of the present invention is a geometrical and visual puzzle assembly intended for entertainment and mental challenge. The puzzle is designed such that the prospective solver arranges the puzzle components in varying arrays in an attempt to achieve consistent transparency or consistent opacity.

The composite puzzle assembly is illustrated in a perspective view in FIG. 1 and is designated by the general reference character 10. As shown in FIG. 1 the composite puzzle 10 is in the shape of one-half of a cube and includes an upper layer 12 and a lower layer 14. Each of the layers 12 and 14 has a length equal to its width equal to four times its height, and is composed of four rectangular solid components or blocks 16. In the upper layer 12 the blocks 16 are shown as having their long axes along the ordinate while each block 16 of the lower layer 14 has its long axis aligned with the abscissa. Of course, the blocks 16 can be physically assembled in any way that a user desires, but the solution of this preferred embodiment requires a 90° relationship between the blocks 16 of upper layer 12 and the blocks 16 of lower layer 14.

Each of the blocks 16 includes an activated area 18 and five transparent surfaces 20. The activated area 18 for each block 16 is arranged to include an entire elongated rectangular side. The activated area 18 is modified to include sub-areas of pre-selected directions of optical polarization. The transparent surfaces 20 have not been so treated. In the illustration of FIG. 1 the activated area 18 of each of the blocks 16 in the lower layer 14 is oriented to be the top surface of the block 16, whereas the activated areas 18 are on the bottom of the blocks 16 in the top layer 12. In this manner the activated area 18 of one block 16 is opposingly juxtaposed in a planar manner with portions of the activated areas 18 of other blocks 16.

An individual block 16 is illustrated in a top plan view in FIG. 2 to illustrate the activated area 18 of the block 16. In the preferred embodiment, the activated area 18 is tinted slightly so that it may be distinguished from the transparent surfaces 20.

Each block 16 is in the form of a rectangular solid having a square cross section and a length equal to four times the width and height. It is constructed entirely out of transparent material with the exception of the activated area 18. With the exception of the timing, there is no apparent visual disparity between the activated area 18 and the three remaining elongated rectangular surfaces.

The activated area 18 is accomplished by a polarized array 22 which is either substituted for or adhered to the transparent material forming the selected rectangular surface of the block 16. In the preferred embodiment, the polarized array 22 includes four distinct polarized panels 24. Each of the polarized panels 24 is square in shape such that the four polarized panels 24 form the polarized array 22 and complete the activated area 18.

The polarized panels 24 are identical in all characteristics except their direction of polarization with respect to visual light. When non-polarized light is directed through any of the polarized panels 24, it will appear to be totally transparent, since all of the light polarized in the same direction as the panel will be transmitted. It is only when the light impinging upon the polarized panel 24 is of a polarization opposite or transverse to the polarization of the panel that transmittal is impeded and the particular panel appears opaque. This effect is accomplished when the light impinging upon the polarized panel 24 has first passed through another polarizing element having a polarization transverse to that of the polarized panel 24.

The polarized panels 24 are divided into two types. For simplicity, the polarities of the polarized panels 24 are limited to polarizations parallel to and perpendicular to the long axis of the block 16. Intermediate polarities would only lead to translucency and could confuse the solver of the puzzle. A panel which is polarized in a direction parallel to the long axis of the block 16 is designated as an axial panel 26 in the drawing. A panel polarized in a direction perpendicular to the long axis of the block 16 is designated as a transverse panel 28. The directions of polarization of the four polarized panels 24 illustrated in FIG. 2 are shown in phantom.

FIG. 3 illustrates an end view of the block 16 of FIG. 2. In this illustration it may be seen that the activated surface 18 in the preferred embodiment is accomplished by adhering the polarized array 22 to the inside surface of a transparent surface 20 of the block 16. In this manner, the polarized panels 24 are located to the interior of the block 16 and thus may not be manipulated in any way by the puzzle solver. They are also less likely to be dislodged during use than exterior panels. The block 16 is hollow to conserve material and to make the entire puzzle assembly 10 lightweight.

An alternate method of construction of the block 16 is to construct the block as a solid piece of material. The activated area 16 is then applied as a strip, or as four individual panels 24 of polarized material to the outside surface of one elongated rectangular side. This alternate method of construction is simpler and easier to manufacture but has disadvantages that the polarized material my come loose from the block and also that it may be manipulated by the puzzle solver.

FIG. 4 and FIG. 5 are top plan views of the puzzle assembly 10 of FIG. 1. FIG. 4 illustrates that polarity of the polarized panels 24 both in the top layer 12 and the bottom layer 14 in a perfectly solved array, that is when the components are arrayed such to achieve complete transparency. FIG. 5 illustrates an imperfect array of blocks 16 in which some of the polarities match and others do not.

An opposing juxtaposition of two polarized panels 24 in a planar manner produces a window square 30. Each window square 30 corresponds to the areas within the borders of the two polarized panels 24 which are visually aligned. A window square 30 may be in the nature of a transparent window 32 when the polarities of the juxtaposed polarized panels 24 are aligned in parallel or in the nature of an opaque window 34 when the polarities of the juxtaposed polarized panels 24 are perpendicularly aligned. For example, an axial panel 26 on a block 16 in the upper layer 12 would need to be juxtaposed with a transverse panel 28 in a block 16 of the lower layer 14 in order to provide a transparent window 32. This condition obtains because the axes of the blocks 16 in the upper layer 12 are perpendicular to the axis of the block 16 in the lower layer 14.

In the illustrations of FIG. 4 and FIG. 5 the polarizations of the polarized panels 24 in the upper layer 12 are shown by solid arrows while the polarizations of the panels 24 in the lower layer 14 are shown by dotted arrows. In the illustration of FIG. 4 it may be seen that the polarizations of the panels 24 in each window 30 are aligned in the same direction. This alignment results in each of the windows 30 of FIG. 4 being transparent windows 32. It does not matter in which direction the polarization of a given polarized panel 24 is aligned in an absolute sense. As long as the polarization of the opposingly juxtaposed panel 24 is aligned in the same direction, the result is equivalent. That is, for a composite construction of the puzzle 10 such as shown in FIG. 1 where the layers have their axes perpendicular to one another, an axial panel 26 in the top layer 12 opposite a transverse panel 28 in the bottom layer 14 results in a transparent window 32 created by having a transverse panel 28 in the top layer 12 and an axial panel 26 in the bottom layer 14.

The illustration of FIG. 5 shows an imperfect construction of the block 16 into the semi-cubical composite of FIG. 1. In the illustration of FIG. 5 it may be seen that several of the windows 30 include perpendicularly polarized opposing panels 24. These result in opaque windows 34. The opaque windows 34 are the result of a pair of transverse panels 28 or axial panels 26 being opposingly juxtaposed with the long axes of the blocks 16 being perpendicular. With the composite construction of the puzzle 10 illustrated on FIG. 5, and observer looking downward through the puzzle 10 would observe transparency in the transparent windows 32, such as the upper right corner window in the illustration but would perceive opacity in the opaque window 34 such as illustrated in the upper left corner.

The puzzle 10 of the present invention is particularly challenging in that each of the blocks 16 possesses total apparent interchangeability. The only difference among the blocks 16 is the particular arrangement of polarized panels 24 in the polarized array 22 of the particular block 16. Since the eight blocks 16 comprising the puzzle assembly 1 can be arrayed in a semi-cubical composite such as is shown in FIG. 1 in many combinations with the polarized arrays 22 being opposingly juxtaposed the chances of a solver randomly arriving upon a solution to the puzzle are very small. When the arrangement of the polarized arrays 22 for the eight block 16 is selected such that there is only one or a few arrangements of the blocks 16 which achieves total transparency it would take the puzzle solver many hours to achieve a solution using a random-iterative approach.

Although it is desirable to have a maximum amount of apparent interchangeability among the blocks 16, it is not desirable to have any real interchangeability. Therefore, the polarized array 22 for each block 16 should be different. From this standpoint, it is important that the particular polarized array 22 does not have any right to left interchangeability with another block. If an axial panel 26 is represented by a 0 and a transverse panel 38 is represented by a 1, then the blocks 16 of FIG. 2 would be represented as 0, 1, 0, 1. It may be seen that such a block 16 would have left to right interchangeability with a block having the array 1, 0, 1, 0 since the block 16 could simply be rotated 180° about a vertical axis to obtain a congruent arrangement of polarities with the block of FIG. 2.

One set of blocks 16 having a totally transparent solution and having no blocks 16 which are interchangeable with one another, is represented by the specifications of Table A.

TABLE A

| Block Number | Polarization Array | | | |
|---|---|---|---|---|
| 1 | 0 | 0 | 0 | 0 |
| 2 | 0 | 1 | 1 | 0 |
| 3 | 0 | 1 | 0 | 1 |
| 4 | 0 | 0 | 0 | 1 |
| 5 | 1 | 1 | 1 | 1 |
| 6 | 1 | 0 | 0 | 1 |
| 7 | 1 | 0 | 1 | 1 |
| 8 | 1 | 1 | 0 | 0 |

Other combinations of block arrangements may be achieved with similar results, however, the arrangement of Table A is one of the simplest. It may be noted that with the arrangement of blocks 16 shown in Table A the blocks 16 may also be arrayed in a manner to achieve total opacity. For transparency, the proper arrangement of blocks is to have the upper layer, from left to right, be blocks number 1, 2, 3, and 4 while the lower layer 14, from back to front, is blocks number 5, 6, 7, and 8. For opacity, the proper array is to have the top layer be number 1, 3, 5, and number 2 while the lower layer 14 is number 7, 4, 8, and number 6.

One method of increasing the complexity of the puzzle 10 is to apply polarized arrays 22 to more than one surface of the block 16. Nothing would be gained by applying the polarized array 22 to the surface opposite the activated area 18 on an existing block 16 since it would have to be the same polarized array 22 or else opacity would be achieved in any case. Therefore, the only logical method would be to apply an additional polarized array 22 to one of the adjacent sides of the block 16. Such an application would increase the number of permutations possible and thus increase the difficulty, since the solver would be unable to distinguish one polarized array 22 from another on a given block 16 and the degree of apparent interchangeability would thus be doubled.

An alternate embodiment of the puzzle assembly 10 employing this method of complexity enhancement could utilize polarized arrays 22 on each of the elongated rectangular surfaces. The opposing arrays 22 would have to be identical so only a single additional degree of freedom would be introduced. However, the symmetry of the blocks would be maintained for aesthetic purposes and the apparent interchangeability would be maximized.

Another method of increasing the complexity and difficulty of the puzzle would be to extend the length of the blocks to include one or more additional polarized panels 24. This would result in a $5\times5$ or $6\times6$ or $N\times N$ array which would be much more difficult to solve than the basic $4\times4$ array of the present invention.

A less elegant method would be to include blocks of different lengths. This would reduce the apparent interchangeability but would introduce an additional degree of difficulty by adding the problem of creating a regular stack as well as visual effect consistency.

Still another method of increasing the complexity would be to include a second set of eight blocks 16, also solvable in the same manner as the original set, with the object being to form a complete transparent cube. This 4×4×4 cube would require having four directly aligned panels 24 of the same polarity in order to achieve transparency. Opacity would be much easier to achieve since any one perpendicularly polarized panel 24 in a light path would preclude light transmittal.

The apparent interchangeability of each of the blocks 16 poses a potential problem in manufacture and distribution. However, this difficulty is only apparent. Although the blocks 16 appear to be identical in ordinary light, the application of a polarized light source will be able to tell by the transparency or opacity of a given polarized panel 24 exactly what the polarized array 22 is for that given block 16.

As discussed in relationship to FIG. 3, the block 16 may be constructed either with the polarized array 22 on the interior of the block 16 or the exterior. Another possibility is to substitute a polarized structural material for the material of one or more of the rectangularly elongated sides. If an interior polarized array 22 is utilized, the block 16 is constructed using two square end panels and four elongated rectangular side panels which fit together to form a unitary rectangular solid. The polarized panels 24 may then be individually applied to the interior surface of one of the elongated rectangular sides.

Although it is desirable to have the entire polarized array 22 to be a continuous strip of material, this is not readily feasible in an economical manner at this time since it is difficult to achieve alternate polarizations on a continuous material. Therefore, the polarized panels 24 are, under current technology, separate elements. The seams will thus be apparent on the block 16, although they could be masked by an opaque overlay material.

The dimensions of a given block are purely a matter of choice. Any set of dimensions which makes the puzzle assembly 10 of an appropriate size for both physical handling and visual observation is acceptable. The selection of materials is likewise a matter of choice. It is important only that the material used to construct the block 16 be transparent and sturdy.

While this invention has been described in terms of a few preferred embodiments, it is contemplated that persons reading the preceding descriptions and studying the drawing will realize various alterations, permutations and modifications thereof. For example, the filters could be colored as well as polarized to add another level of encryption. It is therefore intended that the following appended claims be interpreted as including all such alterations, permutations and modifications as fall within the true spirit and scope of the present invention.

What is claimed is:

1. A puzzle assembly comprising:

a first stackable component, including at least one activated area, each activated area being arrayed along a planar surface thereof, said activated area being divided into twp or more polarized zones, said polarized zones being polarized with respect to visual light in either of two perpendicular directions, where said first stackable component is in the form of a right rectangular solid having a square cross section and a length equal to an integral multiple of its width, and wherein said activated area includes substantially an entire elongated rectangular side thereof; and one or more additional stackable components, compatibly stackable with the first stackable component and of similar construction thereto, where each additional stackable component is also in the form of a rectangular solid of the same nature as the first component and is apparently physically and visually interchangeable with the first component, each additional component including an activated area having polarized zones of the same size and shape as those of the first component, the arrangement of polarized zones in said activated areas of at least some of the additional components being distinguishable from the arrangement of polarized zones on the first component such that when the activated areas of such components are aligned at least some of the window areas formed by juxtaposed polarized zones are opaque to visible light.

2. The puzzle assembly of claim 1 wherein:

said integral multiple is selected to be four;

said activated area of the first component includes exactly four square polarized zones aligned along the long axis of the component; and the additional components differ from the first component only in the direction of polarization with respect to the long axis of the component of at least one of said polarized zones.

3. The puzzle assembly of claim 2 wherein:

the additional components are seven in number and each additional component includes a different array of polarization directions from each other additional component.

4. The puzzle assembly of claim 1 wherein:

one of said perpendicular directions of polarization is parallel to the long axis of the first component.

5. The puzzle assembly of claim 3 wherein:

the arrangement of polarized zones on the stackable components is selected such that at least one stacking array exists wherein all of said window areas are transparent, the stacking array being semi-cubical and including a first layer of four components aligned side by side and a second layer of four components aligned side by side with each other and perpendicular to the components of said first layer, each of said polarized zones of each component being oppositely juxtaposed in a planar manner with exactly one polarized zone of a component in the opposing layer.

6. The puzzle assembly of claim 1 wherein:

each stackable component is hollow and said activated areas are in the form of polarized material bonded to the interior surface of one of the elongated rectangular sides of the component.

7. The puzzle assembly of claim 1 wherein:

the polarized zones of each component are arrayed such that at least one composite stacking array exists with each of said polarized zones opposingly juxtaposed with one other said zone such that the entire composite is transparent.

8. The puzzle assembly of claim 1 wherein:

each stackable component is a solid block of material and said activated areas are in the form of polarized material bonded to the surface of one of the elongated rectangular sides of the component.

9. A method of manufacture of components of a puzzle assembly, in steps comprising:

(a) forming a pair of square end panels for each component;

(b) forming a set of four elongated rectangular side panels out of a visually transparent material for each component, the side panels being adapted to mate with each other and the end panels to form a single rectangular solid;

(c) applying a pattern of polarized zones of material, polarized with respect to visual light, to the surface of at least one of the side panels for each component, the pattern being different for at least some of the side panels; and (d) assembling the end and side panels for each component into a unitary rectangular solid.

10. The method of claim 9 wherein:

the length of the side panels is selected to be an integral multiple of the width of the end panels.

11. The method of claim 10 wherein:

said pattern of polarized zones includes linearly arrayed zones having approximately the same size and shape as the end panels.

12. The method of claim 9 and further including the step of:

(e) packaging together a selection of eight of the assembled components, each component being physically interchangeable therewith but each component having a pattern of polarized zones differing from the pattern of each other component in the arrangement of the direction of polarization of said zones.

13. The method of claim 12 wherein:

the pattern of polarization is applied to only one surface per component and each pattern of polarization includes four linearly aligned square polarized zones, each zone being polarized either in a direction parallel to the long axis of the component or in a direction perpendicular to said long axis.

14. The method of claim 12 wherein, for the eight assembled components being designated as components one through eight respectively, a zone polarized parallel to said long axis is designated 1 and a zone polarized perpendicular to said long axis is designated as 0, the pattern of polarized zones for the components is as follows:

Component one is [0, 0, 0, 0];
Component two is [0, 1, 1, 0];
Component three is [0, 1, 0, 1];
Component four is [0, 0, 0, 1];
Component five is [1, 1, 1, 1];
Component six is [1, 0, 0, 1];
Component seven is [1, 0, 1, 1]; and
Component eight is [1, 1, 0, 0].

15. The method of claim 9 wherein:

said pattern of polarized zones is applied to the interior facing surface of the side panels.

16. The method of claim 9 wherein:

said pattern of polarized zones is applied to one surface of all the side panels with the pattern on opposing side panels of the same component being identical.

17. A puzzle assembly comprising:

a first stackable component, including at least one activated area, each activated area being arrayed along a planar surface thereof, said activated area being divided into two or more polarized zones arranged along a linear axis, said polarized zones being polarized with respect to visual light in either of two perpendicular directions; and one or more additional stackable components, compatibly stackable with the first stackable component and apparently physically and visually interchangeable with said first component, each additional component including an activated area having polarized zones of the same size and shape as those of the first component and similarly aligned along a linear axis, the arrangement of polarized zones in said activated areas of at least some of the additional components being distinguishable from the arrangement of polarized zones on the first component such that when the activated areas of such components are aligned at least some of the window areas formed by juxtaposed polarized zones are opaque to visible light, where each of said stackable components can be rotated end-for-end around a central point along said linear axis.

18. A puzzle assembly as recited in claim 17 wherein the pattern of polarizations of said polarized zones of each stackable component is different when taken in a first direction along said linear axis than if taken along a second direction of said linear axis.

19. A puzzle assembly as recited in claim 17 wherein the pattern of polarization of said polarized zones of each stackable component is unique.

20. A puzzle assembly as recited in claim 17 wherein each of said stackable components includes at least three polarized zones.

* * * * *

UNITED STATES PATENT AND TRADEMARK OFFICE

CERTIFICATE OF CORRECTION

PATENT NO. : 4,491,326

DATED : January 1, 1985

INVENTOR(S) : Donald P. Halsey, III

It is certified that error appears in the above-identified patent and that said Letters Patent is hereby corrected as shown below:

Column 3, line 65 change "timing" to --tinting--;

Column 5, lines 28-30 delete "created by having a transverse panel 28 in the top layer 12 and an axial panel 26 in the bottom layer 14";

Column 6, line 34 change "1, 3, 5, and number 2" to --2, 1, 3, and 5--; and

Column 6, line 35 change "7, 4, 8, and number 6" to --4, 7, 6, and 8--.

Signed and Sealed this

*Twenty-eighth* Day of *May 1985*

[SEAL]

*Attest:*

DONALD J. QUIGG

*Attesting Officer*

*Acting Commissioner of Patents and Trademarks*